US011205532B2

(12) United States Patent
Ito et al.

(10) Patent No.: US 11,205,532 B2
(45) **Date of Patent: *Dec. 21, 2021**

(54) PERMANENT MAGNET AND PERMANENT MAGNET POWDER

(71) Applicant: TDK CORPORATION, Tokyo (JP)

(72) Inventors: Masashi Ito, Tokyo (JP); Yuki Nagamine, Tokyo (JP)

(73) Assignee: TDK CORPORATION, Tokyo (JP)

( * ) Notice: Subject to any disclaimer, the term of this patent is extended or adjusted under 35 U.S.C. 154(b) by 252 days.

This patent is subject to a terminal disclaimer.

(21) Appl. No.: 16/465,397

(22) PCT Filed: Nov. 30, 2017

(86) PCT No.: PCT/JP2017/043073

§ 371 (c)(1),
(2) Date: May 30, 2019

(87) PCT Pub. No.: WO2018/101408

PCT Pub. Date: Jun. 7, 2018

(65) Prior Publication Data

US 2019/0333660 A1 Oct. 31, 2019

(30) Foreign Application Priority Data

Nov. 30, 2016 (JP) ..... JP2016-232114

(51) Int. Cl.

| | |
|---|---|
| ***H01F 1/058*** | (2006.01) |
| ***H01F 1/055*** | (2006.01) |
| ***B22F 1/00*** | (2006.01) |
| ***C22C 33/02*** | (2006.01) |
| ***C22C 38/00*** | (2006.01) |
| *B22F 9/04* | (2006.01) |

(52) U.S. Cl.

CPC ..... *H01F 1/058* (2013.01); *B22F 1/0085* (2013.01); *C22C 33/02* (2013.01); *C22C 38/005* (2013.01); *H01F 1/0551* (2013.01); *H01F 1/0557* (2013.01); *B22F 9/04* (2013.01); *B22F 2301/355* (2013.01); *B22F 2304/10* (2013.01); *C22C 2202/02* (2013.01)

(58) Field of Classification Search

None

See application file for complete search history.

(56) References Cited

U.S. PATENT DOCUMENTS

2016/0276075 A1* 9/2016 Ito ..... H01F 1/058
2020/0005973 A1* 1/2020 Iwasa ..... C22C 38/10

FOREIGN PATENT DOCUMENTS

JP 2008-133496 A 6/2008

OTHER PUBLICATIONS

Feb. 27, 2018 International Search Report issued in International Patent Application No. PCT/JP2017/043073.

Saito et al; "Magnetic properties of (Sm,Y)5Fe17 melt-spun ribbons;" Journal of Applied Physics; vol. 109 pp. 07A724-1-07A724-3; 2011.

Saito et al; "Synthesis and magnetic properties of (Pr1—xSmx)5Fe17(x=0-1) phase;" Journal of Alloys and Compounds; vol. 488; pp. 13-17; Aug. 18, 2009.

* cited by examiner

*Primary Examiner* — Xiaowei Su
(74) *Attorney, Agent, or Firm* — Oliff PLC

(57) ABSTRACT

A permanent magnet includes R and T (R essentially includes Sm one or more of rare earth elements in addition to Sm, and T essentially includes Fe, or Fe and Co, one or more of transition metal elements in addition to Fe, or Fe and Co). A composition ratio of R in the permanent magnet is 20 at % or more and 40 at % or less. A remaining part is substantially only T, or only T and C. T amount is more than 1.5 times of R amount and less than 4.0 times of the R amount. Main phase grains included in the permanent magnet have an Nd5Fe17 type crystal structure. An average crystal grain size of the main phase grains of the permanent magnet is greater than 1 μm. A number ratio of main phase grains having a crystal grain size of less than 0.4 μm is less than 20%.

8 Claims, No Drawings

PERMANENT MAGNET AND PERMANENT MAGNET POWDER

BACKGROUND OF THE INVENTION

The present invention relates to a permanent magnet including a compound having an $Nd_5Fe_{17}$ type crystal structure (a space group $P6_3/mcm$) as a main phase.

An R-T-B based permanent magnet that is representative of a high-performance permanent magnet is increased in production volume year by year due to high magnetic properties, and thus, the R-T-B based permanent magnet is widely used for various motors, various actuators, an MRI device, and the like. Here, R is at least one of rare earth elements, T is Fe or Fe and Co, and B is boron.

Since an R-T-B based permanent magnet such as mentioned in above having an intermetallic compound as a main phase has been developed, research of permanent magnets has been mainly focused on trying to find a new intermetallic compound of rare earth metals. Among these, a permanent magnet having an $Sm_5Fe_{17}$ intermetallic compound as a main phase as described in Patent Document 1 attains extremely high coercivity of 37 kOe at a room temperature. Therefore, the permanent magnet material described in Patent Document 1 having the $Sm_5Fe_{17}$ intermetallic compound as a main phase is considered as a promising permanent magnet material.

However, as described in Non-Patent Document 1, the permanent magnet material having the $Sm_5Fe_{17}$ intermetallic compound as a main phase has residual magnetization lower than that of the permanent magnet material of the related art, and thus, it is difficult to manufacture a high-performance magnet.

Therefore, in Non-Patent Document 2, the residual magnetization is improved by substituting an Sm with Pr. However, in a case where the Sm is substituted with Pr, a problem arises that the coercivity decreases or the cost increases.

[Patent Document 1] JP Patent Application Laid Open No. 2008-133496

[Non-Patent Document 1] Journal of Applied Physics 109 07A724 (2011)

[Non-Patent Document 2] Journal of Alloys and Compounds 488 (2009) 13-17

BRIEF SUMMARY OF INVENTION

The present invention is attained in view of such problems of the related art described above, and the object is to provide a permanent magnet and the like having a compound of an $Nd_5Fe_{17}$ type crystal structure having high residual magnetization and a high coercivity, as a main phase.

In order to attain the above object, the present inventors have carried out earnest examinations of a compound having an $Nd_5Fe_{17}$ type crystal structure. As a result, the present inventors have found that by increasing the average crystal grain size and reducing fine grains, the residual magnetization increases while retaining a high coercivity.

The invention provides a permanent magnet including R and T (R is essentially Sm or is at least one selected from rare earth elements in addition to Sm; and T is essentially Fe or a combination of Fe and Co or is at least one selected from transition metal elements in addition to Fe or the combination of Fe and Co), in which a composition ratio of R in the permanent magnet is 20 at % or more and 40 at % or less, a remaining part is substantially only T, or only T and C, T amount is more than 1.5 times of R amount and less than 4.0 times of the R amount, main phase grains included in the permanent magnet have an $Nd_5Fe_{17}$ type crystal structure, an average crystal grain size of the main phase grains of the permanent magnet is more than 1 μm, and a number ratio of main phase grains having a crystal grain size of less than 0.4 μm is less than 20%.

In the permanent magnet of the invention in which the main phase has the $Nd_5Fe_{17}$ type crystal structure, the average crystal grain size is more than 1 μm, and the number ratio of the main phase grains having the crystal grain size of less than 0.4 μm is less than 20%, and thus, residual magnetization is improved compared to a permanent magnet of the related art in which main phase grains have an $Nd_5Fe_{17}$ type crystal structure. Furthermore, the $Nd_5Fe_{17}$ type crystal structure is a crystal structure similar to a crystal structure of an $Nd_5Fe_{17}$ intermetallic compound. In addition, the invention is not limited to a case where R is Nd, and T is Fe.

In the permanent magnet of the invention, the average crystal grain size of the main phase grains increases, and fine grains having a crystal grain size of less than 0.4 μm are reduced. Accordingly, the inventors have considered that the degree of orientation or crystallinity increases in the permanent magnet of the invention, compared to the permanent magnet of the related art in which the main phase grains have the $Nd_5Fe_{17}$ type crystal structure, and thus, the residual magnetization is improved in the permanent magnet of the invention. A permanent magnet powder can be several μm by mechanical pulverization. An anisotropic permanent magnet can be obtained by an orientation treatment in which pulverized grains are molded in a magnetic field, and residual magnetization larger than that of an isotropic magnet can be obtained. However, in a case where the ratio of the fine grain having the crystal grain size smaller than a pulverized grain size increases, crystal orientation of the pulverized grains are not uniform. For this reason, in a case where the ratio of the fine grain having the crystal grain size smaller than the pulverized grain size increases, crystal axes are not aligned, and the residual magnetization does not increase even in a case where the orientation treatment is performed after a pulverization treatment.

The inventors have considered that in the permanent magnet of the invention, when an $R_5T_{17}$ crystal phase in a thermal treatment is subjected to crystal growth to be 1 μm or more, the decomposition of the $R_5T_{17}$ crystal phase is suppressed, and thus, it is possible to obtain a high coercivity equivalent to that of the permanent magnet of the related art in which a main phase has the $Nd_5Fe_{17}$ type crystal structure. The process of the thermal treatment is performed in two steps, and thus, it is possible to increase the average crystal grain size while suppressing the decomposition of the $R_5T_{17}$ crystal phase, and it is possible to reduce the fine grains. Accordingly, it has been found that the residual magnetization increases while retaining a high coercivity equivalent to that of the permanent magnet of the related art in which the main phase has the $Nd_5Fe_{17}$ type crystal structure. Furthermore, a phase having the $Nd_5Fe_{17}$ type crystal structure will be referred to as the $R_5T_{17}$ crystal phase. Similarly, for example, a phase having a $CaCu_5$ type crystal structure including R and T will be referred to as an $RT_5$ crystal phase.

Further, it is preferable that C amount is more than 0 at % and 15 at % or less in the permanent magnet of the invention. Accordingly, magnetic properties of the permanent magnet easily increase.

It is preferable that the average crystal grain size of the main phase grains is less than 10 μm, in the permanent magnet of the invention. Accordingly, it is possible to decrease main phase grains to be a multi-domain structure, and it is possible to obtain a more excellent coercivity.

It is preferable that a ratio of Sm to an entire R is 50 at % or more and 99 at % or less, and a ratio of a total of Pr and Nd to the entire R is 1 at % or more and 50 at % or less, in the permanent magnet of the invention.

Further, the invention also provides a permanent magnet powder including R and T (R is essentially Sm or is at least one selected from rare earth elements in addition to Sm; and T is essentially Fe or a combination of Fe and Co or is at least one selected from transition metal elements in addition to Fe or the combination of Fe and Co), in which a composition ratio of R in the permanent magnet powder is 20 at % or more and 40 at % or less, a remaining part is substantially only T, or only T and C, T amount is more than 1.5 times of R amount and less than 4.0 times of the R amount, main phase grains included in the permanent magnet powder have an $Nd_5Fe_{17}$ type crystal structure, an average crystal grain size of the main phase grains of the permanent magnet powder is more than 1 μm, and a number ratio of main phase grains having a crystal grain size of less than 0.4 μm is less than 20%.

The permanent magnet powder of the invention exhibits excellent magnetic properties such as large residual magnetization while retaining a high coercivity.

Further, it is preferable that C amount is more than 0 at % and 15 at % or less in the permanent magnet powder of the invention. Accordingly, magnetic properties of the permanent magnet powder easily increase.

It is preferable that the average crystal grain size of the main phase grains is less than 10 μm, in the permanent magnet powder of the invention. Accordingly, it is possible to decrease the main phase grains to be the multi-domain structure, and it is possible to obtain a more excellent coercivity.

It is preferable that a ratio of Sm to an entire R is 50 at % or more and 99 at % or less, and a ratio of a total of Pr and Nd to the entire R is 1 at % or more and 50 at % or less, in the permanent magnet powder of the invention.

Further, an anisotropic bond magnet, including: the permanent magnet powder of the invention; and a resin is also provided. The anisotropic bond magnet of the invention exhibits excellent magnetic properties such as large residual magnetization while retaining a high coercivity.

Further, an anisotropic sintered magnet is also provided by using the permanent magnet powder of the invention. The anisotropic sintered magnet of the invention exhibits excellent magnetic properties such as large residual magnetization while retaining a high coercivity.

According to the invention, it is possible to provide a permanent magnet having a compound of an $Nd_5Fe_{17}$ type crystal structure having high residual magnetization and a high coercivity, as a main phase.

DETAILED DESCRIPTION OF INVENTION

Hereinafter, embodiments for carrying out the present invention are described in detail. The present invention is not to be limited to a context described below embodiments. A constituting element of the below described embodiments includes those one ordinary skilled in the art can easily attain, and those substantially the same. Further, the constituting element described below embodiments can be combined accordingly.

A permanent magnet according to the present embodiment is a permanent magnet including R and T (R is essentially Sm or is at least one selected from rare earth elements in addition to Sm; and T is essentially Fe or a combination of Fe and Co or is at least one selected from transition metal elements in addition to Fe or the combination of Fe and Co), in which a compositional ratio of R in the permanent magnet is 20 at % or more and 40 at % or less, a remaining part is substantially T only, or a combination of T and C only, T amount is more than 1.5 times of R amount and less than 4.0 times of the R amount, main phase grains included in the permanent magnet have an $Nd_5Fe_{17}$ type crystal structure, an average crystal grain size of the main phase grains of the permanent magnet is more than 1 μm, and a number ratio of main phase grains having a crystal grain size of less than 0.4 μm is less than 20%.

In the permanent magnet according to this embodiment, an $RT_2$ crystal phase, an $RT_3$ crystal phase, an $R_2T_7$ crystal phase, an $RT_5$ crystal phase, an $RT_7$ crystal phase, an $R_2T_{17}$ crystal phase, and an $RT_{12}$ crystal phase may be included if an $R_5T_{17}$ crystal phase is a main phase. Here, the main phase is a crystal phase having the highest volume ratio in the permanent magnet.

A volume ratio of the $R_5T_{17}$ crystal phase to the permanent magnet according to the present embodiment is 50% or more, and preferably 75% or more.

In the permanent magnet according to the present embodiment, R includes Sm and also includes at least one element selected from rare earth elements. The ratio of Sm to entire rare earth elements is preferably large, and an atomic ratio of Sm to entire rare earth elements is preferably 50 at % or more.

Preferably, a ratio of Sm in the entire R is 50 at % or more and 99 at % or less, and a ratio of total of Pr and Nd in the entire R is 1 at % or more and 50 at % or less. In case Pr and/or Nd are included 1 at % or more in total, the residual magnetization improves compared to the case of having a total amount of Pr and/or Nd of less than 1 at %. This is because magnetic moments of $Nd^{3+}$ and $Pr^{3+}$ are larger than a magnetic moment of $Sm^{3+}$. Note that, when a ratio of total of Pr and Nd is larger than 50 at %, a magnetocrystalline anisotropy and the coercivity decrease compared to the case of having a ratio of total of Pr and Nd of 1 at % or more and 50 at % or less. This is because Stevens factor of $Nd^{3+}$ and $Pr^{3+}$ are smaller than that of $Sm^{3+}$. When a ratio of total of Pr and Nd is larger than 50 at %, a ratio of an $R_2T_{17}$ phase having in-plane anisotropy increases. When the $R_2T_{17}$ phase increases, this causes to form a kink near 0 magnetic field of a demagnetization field.

The R amount in the permanent magnet according to this embodiment is 20 at % or more and 40 at % or less. In a case where the R amount is less than 20 at %, it is difficult to obtain the $R_5T_{17}$ crystal phase, and the coercivity and the residual magnetization remarkably decrease. On the other hand, in a case where the R amount is more than 40 at %, the $RT_2$ crystal phase and the like having a low coercivity are greatly generated, and thus, the coercivity and the residual magnetization remarkably decrease.

In the permanent magnet according to the present embodiment, T is Fe or a combination of Fe and Co, and also at least one element selected from transition metal elements. Co amount is preferably 20 at % or less with respect to the entire transition metal elements. By selecting appropriate Co amount, a saturation magnetization can be improved. In addition, by increasing in the Co amount, a corrosion resistance of the permanent magnet can be improved.

In a relationship between R amount and the T amount, the T amount is more than 1.5 times of the R amount and is less than 4.0 times of the R amount, at an atomic number ratio.

In a case where the T amount is 1.5 times or less of the R amount, the $RT_2$ crystal phase is greatly generated, and the residual magnetization and the coercivity remarkably decrease. In a case where the T amount is 4.0 times or less of the R amount, a low coercivity component such as an α-Fe crystal phase is greatly generated, and the coercivity remarkably decreases.

In the permanent magnet according to the present embodiment, the average crystal grain size of the $R_5T_{17}$ crystal phase is more than 1 μm. In a case where the average crystal grain size is 1 μm or less, only comparatively small residual magnetization is obtained.

In addition, a number ratio of main phase grains in which the crystal grain size of the $R_5T_{17}$ crystal phase with respect to all of the main phase grains is less than 0.4 μm is less than 20%. In a case where the ratio is 20% or more, the degree of orientation of the main phase grain decreases, and excellent residual magnetization is not obtained.

Hereinafter, an evaluation method of the crystal grain size will be described. First, a cross-sectional surface of the permanent magnet that is machined by an FIB is observed by using an STEM. An STEM-HAADF image is imported in image analysis software, 200 main phase grains having the $Nd_5Fe_{17}$ type crystal structure are selected, and a circle equivalent diameter calculated from a cross-sectional area of each of the grains is set to the crystal grain size. Next, the average crystal grain size is obtained. The average crystal grain size is set to an arithmetic average value represented by (sum of grain size of all main phase grains)/(number of observed main phase grains). In addition, the ratio of the main phase grains having the crystal grain size of less than 0.4 μm is calculated by an expression of (number of main phase grains having crystal grain size of less than 0.4 μm)/(number of observed main phase grains).

The permanent magnet according to the present embodiment preferably includes C of more than 0 at % and 15 at % or less. By including a suitable C amount, it is possible to increase an interatomic distance between T-T, and increase an exchange interaction between T-T. Accordingly, magnetic properties of the permanent magnet easily increase. When the C amount is more than 15 at %, the ratio of the $R_5T_{17}$ crystal phase to be obtained decreases, and the magnetic properties tend to decrease.

An identification method of the C amount of the permanent magnet will be described. The cross section of the permanent magnet that is machined by the FIB described above is observed by using an STEM-EDS. 200 grains of the permanent magnet are selected from an observation image, and the C amount is measured from an EDS analysis value each of the grains. Then, an arithmetic average value represented by (sum of C amount of each of grains)/(number of observed grains) is set to the C amount of the permanent magnet. In addition, the R amount and the T amount are analyzed by ICP, an analysis result is complemented, and a composition ratio of a permanent magnet powder part is determined.

Also, the permanent magnet according to the present embodiment may include elements other than C. As the elements other than C, at least one element selected from the group consisting of N, H, Be, and P can be used. Further, the permanent magnet according to the present embodiment may include other elements. For example, elements such as Bi, Sn, Ga, Si, Ge, Zn, and the like can be included accordingly. Also, the permanent magnet may include impurities derived from a raw material. An amount of these elements is specifically 5 at % or less in total, and it is about the amount so that the remaining part other than R in the permanent magnet can be considered T only or a combination of T and C only.

In the permanent magnet according to this embodiment, the average crystal grain size of the main phase grains is preferably less than 10 μm. The average crystal grain size of the main phase grains is less than 10 μm, and thus, it is possible to decrease main phase grains to be a multi-domain structure, and it is possible to obtain a more excellent coercivity.

The shape of the permanent magnet according to the present embodiment can be a desired shape according to a press mold to be used at a molding (for example, a cylindrical shape, a columnar shape, a tabular shape, a C shape, and the like). In addition, an anisotropic permanent magnet in a desired orientation direction can be obtained according to an applied magnetic field direction at the molding. It is more preferable that a ratio of a residual magnetization value measured in parallel with an orientation direction to the maximum magnetization value obtained in the maximum applied magnetic field of 100 kOe, that is, (residual magnetization value)/(maximum magnetization value) is 80% or more. It is possible to provide a permanent magnet sufficiently exhibiting the potential of the magnet material, by increasing (residual magnetization value)/(maximum magnetization value).

Hereinafter, a preferred example of a producing method of the present embodiment will be described. A producing method of the permanent magnet includes a sintering method, a super rapid solidification method, a vapor deposition method, an HDDR method, and the like, and an example of the producing method using the super rapid solidification method will be described. A single-roller method, a double-roller method, a centrifugal quenching method, a gas atomizing method, and the like are exemplified as a specific super rapid solidification method, and it is preferable to use the single-roller method. In the single-roller method, a molten alloy is ejected from a nozzle, and is impacted on a circumferential surface of a quenching roller, and thus, the molten alloy is rapidly cooled, and a ribbon-shaped or flake-shaped quenched alloy is obtained. The single-roller method has high mass productivity and excellent reproducibility of a rapid cooling condition, compared to other super rapid solidification methods.

An R-T alloy having a desired composition ratio is prepared as a raw material. A raw material alloy can be prepared by melting each raw material of R and T in an inert gas atmosphere, desirably in an Ar atmosphere, by a melting method such as an arc melting or other known melting methods. Similarly, even in the case of suitably including other elements, for example, Bi, Sn, Ga, Si, Ge, Zn, and the like, the other elements can be included by the melting method.

An amorphous alloy is prepared from the R-T alloy prepared by the method described above, using the super rapid solidification method. It is desirable that the super rapid solidification method is a melt-spinning method in which a small piece of an alloy ingot is high frequency melted in an Ar atmosphere, and a molten metal is ejected onto a copper roller that is rotating at a high velocity, and is rapidly cooled and solidified. The molten metal that is rapidly cooled by the roller becomes a quenched alloy that is rapidly cooled and solidified into a ribbon shape.

The quenched alloy exhibits any structural shape of an amorphous single phase, a multiphase of an amorphous phase and a crystal phase, or a crystal phase, depending on a composition ratio and a circumferential velocity of the quenching roller. The amorphous phase becomes a fine crystal phase by a thermal treatment (a crystallization treatment) performed later. In a case where the circumferential velocity of the quenching roller increases, an occupation ratio of the amorphous phase increases, as one criterion.

In a case where the circumferential velocity of the quenching roller increases, a quenched alloy to be obtained becomes thin, and thus, a more uniform quenched alloy is obtained. The structure of the amorphous single phase is obtained, and then, the $R_5T_{17}$ crystal phase can be obtained by a suitable thermal treatment. Therefore, in the present embodiment, an alloy having the amorphous single phase, or an alloy having the amorphous phase and the $R_5T_{17}$ crystal phase is preferably obtained. For this reason, the circumferential velocity of the quenching roller, in general, is in a range of 10 m/s to 100 m/s, is preferably in a range of 15 m/s to 75 m/s, and is more preferably in a range of 25 m/s to 65 m/s. In a case where the circumferential velocity of the quenching roller is less than 10 m/s, an uniform quenched alloy is not obtained, and a desired crystal phase tends not to be easily obtained. In a case where the circumferential velocity of the quenching roller is more than 100 m/s, adhesiveness between the molten alloy and the circumferential surface of the quenching roller is degraded, and a thermal migration tends not to be effectively performed.

Next, the quenched alloy is subjected to a crystallization treatment. The crystallization treatment is performed in the following procedure. First, a heating is performed to a first crystallization temperature at a heating rate of at 10° C./s to 30° C./s. The first crystallization temperature is 750° C. to 950° C. Next, the quenched alloy is kept at the first crystallization temperature for 0.5 minutes to 5 minutes. After that, a cooling is performed to a second crystallization temperature at a cooling rate of 10° C./s to 30° C./s. The second crystallization temperature is 600° C. to 700° C. Next, the quenched alloy is kept at the second crystallization temperature for 1 hour to 720 hours. In general, such a treatment is performed in an Ar atmosphere. The rapid heating to the first crystallization temperature, the rapid cooling to the second crystallization temperature, then crystal grains are subjected to grain growth at the second crystallization temperature lower than the first crystallization temperature, and thus, a crystal grain size of the main phase of more than 1 μm is formed in the alloy. In a case where the first crystallization temperature is lower than 750° C., the $R_5T_{17}$ crystal phase tends not to be obtained. In addition, in a case where the first crystallization temperature is higher than 950° C., the generated $R_5T_{17}$ crystal phase is decomposed, and the coercivity tends to decrease. In a case where the second crystallization temperature is lower than 600° C., the average crystal grain size tends not to be more than 1 μm. In addition, in a case where the second crystallization temperature is higher than 700° C., the ratio of fine grains increases and the degree of orientation tends to decrease. The thermal treatment is performed in which the rapid heating to the first crystallization temperature, the rapid cooling to the second crystallization temperature, then crystals are subjected to grain growth at the second crystallization temperature lower than the first crystallization temperature, and thus, the $R_5T_{17}$ crystal phase is not decomposed in the alloy, the average crystal grain size is grown to be more than 1 μm, and it is possible to reduce the ratio of grains of abnormal grain growth or the fine grains.

In a case where C is included in the permanent magnet, the crystallization treatment described above is performed with respect to the quenched alloy, and then, a carbonization treatment is performed. The temperature of the carbonization treatment is 450° C. to 600° C. A time for the carbonization treatment is arbitrary, and in general, is approximately 0.6 minutes to 600 minutes. The atmosphere of the carbonization treatment is a carbonization atmosphere such as $Ar+CH_4$ or $Ar+C_2H_6$. Here, the concentration of hydrocarbon gas is adjusted to be 1 wt % to 45 wt %, and thus, the R-T alloy reacts with C, and C forms solid solution in the $R_5T_{17}$ crystal phase.

The quenched alloy that is subjected to the crystallization treatment, or the crystallization treatment and the carbonization treatment is pulverized, and thus, a permanent magnet powder is obtained.

The pulverization of the quenched alloy that is subjected to the crystallization treatment, or the crystallization treatment and the carbonization treatment described above is performed by using an agate mortar. It is desirable that a pulverization process is performed at a low oxygen concentration, and for example, it is desirable that the pulverization is performed at an oxygen concentration of 100 ppm or less.

Furthermore, a method of the pulverization process is arbitrary. Hydrogen storage pulverization or pulverization using a pulverizer such as brown mill or a jaw crusher may be performed, or pulverization using a pulverizer such as a jet mill or a bead mill may be performed. Furthermore, the hydrogen storage pulverization is a pulverization method in which hydrogen is stored in the alloy, and then, the alloy is crushed by a self-collapsing causing from dehydrogenation to release hydrogen depending on a difference in a hydrogen storage amount between different phases.

The anisotropic permanent magnet is prepared by using the pulverized permanent magnet powder. The permanent magnet powder is subjected to magnetic field orientation, and thus, becomes anisotropic. A magnetic field is applied, and thus, a crystal axis of the permanent magnet powder is oriented in a certain direction, and the residual magnetization improves.

Next, a producing method of the anisotropic bond magnet using the permanent magnet powder obtained by this embodiment will be described. The anisotropic bond magnet is a magnet obtained by molding a compound (composition) for an anisotropic bond magnet that is obtained by kneading a resin binder including a resin and the permanent magnet powder into a predetermined shape. The anisotropic bond magnet is obtained by applying a magnetic field at the time of molding, and by orienting the crystal axis of the permanent magnet powder included in the compound in a certain direction.

First, the binder and the permanent magnet powder, for example, are kneaded with a pressure kneading machine such as a pressure kneader, and thus, the compound (composition) for an anisotropic bond magnet is prepared. The binder is a binder that is used for solidifying and forming the permanent magnet powder as a magnet. In this embodiment, a resin is used as the binder. The type of resin is arbitrary, and for example, may be a thermosetting resin such as an epoxy resin and a phenolic resin, or a thermoplastic resin such as a styrene-based elastomer, an olefin-based elastomer, a urethane-based elastomer, a polyester-based elastomer, and a polyamide-based elastomer, an ionomer, an ethylene propylene copolymer (EPM), and an ethylene-ethyl acrylate copolymer. Among them, the thermosetting resin is preferable, and the epoxy resin or the phenolic resin is more preferable, as a resin used for compression molding. In addition, the thermoplastic resin is preferable as a resin used for injection molding. In addition, a coupling agent or other additives may be added to the compound for an anisotropic bond magnet, as necessary.

In addition, in an amount ratio of the permanent magnet powder and the resin in the anisotropic bond magnet, it is preferable to include the resin of 0.5 mass % or more and 20 mass % or less, with respect to 100 mass % of the permanent magnet powder. In a case where the amount of the resin is less than 0.5 mass % with respect to 100 mass % of the permanent magnet powder, shape retaining properties tend to be impaired, and in a case where the amount of the resin is more than 20 mass %, sufficiently excellent magnetic properties tend not to be easily obtained.

The compound for an anisotropic bond magnet described above is adjusted, and then, the compound for an anisotropic bond magnet is subjected to injection molding, and thus, it is possible to obtain the anisotropic bond magnet including the permanent magnet powder and the resin. In a case where the anisotropic bond magnet is prepared by the injection molding, the compound for an anisotropic bond magnet is heated to a melting temperature of the resin (the thermoplastic resin) to be in a fluid state as necessary, and then, is injected into a press mold of a predetermined shape, and thus, is molded. After that, the press mold and a molded article are cooled, and the molded article having a predetermined shape is taken out from the press mold. As described above, the anisotropic bond magnet is obtained.

In addition, the compound for an anisotropic bond magnet is subjected to compression molding, and thus, the anisotropic bond magnet including the permanent magnet powder and the resin may be obtained. In a case where the anisotropic bond magnet is prepared by the compression molding, the compound for an anisotropic bond magnet described above is prepared, and then, the compound for an anisotropic bond magnet fills the press mold of a predetermined shape, a pressure is applied to the compound for an anisotropic bond magnet, and the molded article having a predetermined shape is taken out from the press mold. The pressure is applied to the compound for an anisotropic bond magnet filling the press mold by using a compression molding machine such as a mechanical press machine or a hydraulic press machine. After that, the compound for an anisotropic bond magnet is put into a furnace such as a heating furnace or a vacuum drying furnace, and the resin is hardened by being heated, and thus, the anisotropic bond magnet is obtained.

The shape of the anisotropic bond magnet to be obtained by being molded is not particularly limited, and can be changed according to the shape of the press mold to be used, for example, a tabular shape, a columnar shape, and a ring shape. In addition, the surface of the obtained anisotropic bond magnet may be subjected to plating or coating in order to prevent an oxidized layer, a resin layer, and the like from being degraded.

When the compound for an anisotropic bond magnet is molded, a magnetic field is applied, and thus, the crystal axis of the permanent magnet powder is oriented in a certain direction. Accordingly, the anisotropic bond magnet is oriented in a specific direction, and thus, the anisotropic bond magnet having a stronger magnetic force is obtained. The applied magnetic field may be approximately 5 kOe to 25 kOe.

The above description indicates a basic process for obtaining the anisotropic permanent magnet of the invention, and the quenched alloy subjected to the crystallization treatment can also be the anisotropic permanent magnet according to a known technology such as a hot deforming method. In addition, the anisotropic sintered magnet can also be obtained by molding in the magnetic field and sintering the permanent magnet powder after the pulverization.

Next, a preferred example of the producing method of the anisotropic sintered magnet using the permanent magnet powder that is subjected to the pulverization treatment, obtained by this embodiment, will be described. First, the permanent magnet powder subjected to the pulverization treatment is molded in the magnetic field, and thus, a green compact is prepared. Specifically, the permanent magnet powder fills the press mold that is arranged between electromagnets, a magnetic field is applied by the electromagnets, and thus, the molding is performed by pressurizing the magnetic powder while orienting the crystal axis of the permanent magnet powder. The molding in the magnetic field, for example, may be performed at a pressure of approximately 30 MPa to 300 MPa in a magnetic field of 1000 kA/m to 1600 kA/m.

The green compact described above is sintered, and thus, the anisotropic sintered magnet is obtained. A spark plasma sintering method ((SPS) method) can be used as a sintering method of the anisotropic sintered magnet. In a case where the sintering is performed by the SPS method, it is preferable that a sintering keeping temperature is 500° C. to 800° C., and a treatment time is 3 minutes to 10 minutes. The sintering keeping temperature is set in such a range, and the sintering keeping time is set to a short period of time, and thus, it is possible to control a grain size distribution by suppressing the grain growth of the main phase grain, and it is possible to obtain the anisotropic sintered magnet having high magnetic properties. In a case where the sintering keeping temperature is lower than 500° C., a magnet density does not sufficiently increase, and thus, a residual magnetic flux density tends to decrease. In a case where the sintering keeping temperature is higher than 800° C., the residual magnetization and the coercivity tend to decrease due to partial decomposition of the $R_5T_{17}$ crystal phase. It is necessary to adjust the sintering keeping temperature and the sintering keeping time according to conditions such as a raw material alloy composition, the pulverization method, a difference in the average grain size and the grain size distribution, and the sintering method.

As described above, the producing method of the permanent magnet of this embodiment has been described, and hereinafter, a method of analyzing the composition ratio of the permanent magnet of this embodiment will be described.

An X-ray Diffractometry (XRD) is used for analyzing the generated phase of the anisotropic bond magnet. In addition, an Inductively Coupled Plasma (ICP) Mass Spectrometry and a Scanning Transmission Electron Microscope-Energy Dispersive X-ray Spectrometry (STEM-EDS) of a specimen cross-sectional surface are used for analyzing the composition ratio of the permanent magnet powder part of the anisotropic bond magnet. The crystal grain size of the main phase grain of the anisotropic bond magnet can be measured by observing the specimen cross-sectional surface that is machined by a Focused Ion Beam (FIB) with a Scanning Electron Microscope (SEM) and a Scanning Transmission Electron Microscope (STEM).

Furthermore, as with the anisotropic bond magnet, the generated phase or the composition ratio, and the crystal grain size of the permanent magnet powder or the anisotropic sintered magnet can be measured.

EXAMPLES

Hereinafter, the contents of the invention will be described in detail by using examples and comparative examples, but the invention is not limited to the following examples.

A permanent magnet according to Example 1 will be described. Sm and Fe were blended at a composition ratio shown in Table 1, were arc melted in an Ar atmosphere, and thus, an ingot was prepared, and then, was broken into small pieces by using a stamp mill. The small pieces were high frequency melted in an Ar atmosphere, and were rapidly cooled by a single roller method at a circumferential velocity of 40 m/s, and thus, a quenched alloy was obtained. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 2 hours. After that, the obtained quenched alloy was rapidly cooled at 20° C./s. A crystallization treatment process was performed in an Ar atmosphere.

The obtained alloy was pulverized by using an agate mortar in a glove box with an oxygen concentration of 50 ppm or less until metallic luster disappeared. A straight-chain type polyphenylene sulfide (PPS) resin (Melting Point; 280° C.) was used as a thermoplastic resin. The amount of the thermoplastic resin was weighed to be 10 mass % with respect to 100 mass % of a permanent magnet powder, and was kneaded at 300° C. for 2 hours by using a pressure heating kneader, and thus, a compound was obtained.

Next, an anisotropic bond magnet was prepared by using a magnetic field injection molding machine. An injection temperature was 300° C., a press molding temperature was 140° C., and an applied magnetic field of the injection molding was 20 kOe. A magnet obtained in magnetic field injection molding had a cylindrical shape, a diameter of 10 mm, and a length of 7 mm.

Subsequently, an evaluation method of a crystal grain size in this example will be described. A cross-sectional surface of the anisotropic bond magnet that was machined by an FIB was observed by using an STEM. An STEM-HAADF image was imported in image analysis software, 200 main phase grains having an $Nd_5Fe_{17}$ type crystal structure were selected, and a circle equivalent diameter calculated from a cross-sectional area of each of the grains was set to the crystal grain size. Next, the average crystal grain size was obtained. The average crystal grain size was set to an arithmetic average value represented by (sum of grain size of the main phase grains)/(number of observed main phase grains). In addition, the ratio of main phase grains having a crystal grain size of less than 0.4 μm was calculated by an expression of (number of main phase grains having crystal grain size of less than 0.4 μm)/(number of observed main phase grains).

Subsequently, an identification method of C amount of a permanent magnet powder part in this example will be described. The cross-sectional surface of the anisotropic bond magnet that was machined by the FIB described above was observed by using STEM-EDS. 200 grains of the magnet using the alloy that was subjected to the carbonization treatment were selected, and the C amount was measured from an EDS analysis value of each of the grains. An arithmetic average value represented by (sum of C amount of each of grains)/(number of observed grains) was set to the C amount to be included in the permanent magnet powder part. R amount and T amount were analyzed by ICP, an analysis result was complemented, and a composition ratio of the permanent magnet powder part was determined. Subsequently, the generated phase of the permanent magnet that was the specimen was analyzed by XRD measurement.

A measurement method of magnetic properties of each specimen will be described. Pulse BH measurement was performed in a direction parallel to an orientation direction of the obtained anisotropic bond magnet. Residual magnetization, coercivity, and the value of the maximum magnetization obtained by the maximum applied magnetic field were obtained from a magnetization curve of the maximum magnetic field of ±100 kOe.

The values of the composition ratio of the permanent magnet powder part, the ratio of the main phase grains having the crystal grain size of less than 0.4 μm, the average crystal grain size, the residual magnetization, and the coercivity of Example 1 to Example 29 and Comparative Examples 1 to Comparative Example 10 are shown in Table 1. The values of the composition ratio of the permanent magnet powder part, the ratio of the main phase grains having the crystal grain size of less than 0.4 μm, the average crystal grain size, the residual magnetization, and the coercivity of Example α to Example ρ are shown in Table 2.

TABLE 1

| | Sm (at %) | Fe (at %) | C (at %) | Ce (at %) | T amount/R amount | Ratio (%) of main phase grains having crystal grain size of less than 0.4 μm | Average crystal grain size (μm) | Mr (kG) | Hc (kOe) |
|---|---|---|---|---|---|---|---|---|---|
| Example 1 | 25.9 | 74.1 | — | — | 2.86 | 18 | 1.1 | 8.3 | 38.6 |
| Example 2 | 25.7 | 74.3 | — | — | 2.89 | 12 | 2.2 | 8.2 | 35.4 |
| Example 3 | 25.6 | 74.4 | — | — | 2.91 | 10 | 3.0 | 8.6 | 32.1 |
| Example 4 | 25.8 | 74.2 | — | — | 2.88 | 8 | 5.0 | 9.0 | 29.2 |
| Example 5 | 26.0 | 74.0 | — | — | 2.85 | 7 | 7.4 | 9.5 | 23.4 |
| Example 6 | 25.6 | 74.4 | — | — | 2.91 | 6 | 9.3 | 10.1 | 18.9 |
| Example 7 | 26.8 | 73.2 | — | — | 2.73 | 5 | 13.8 | 10.0 | 9.2 |
| Example 8 | 17.2 | 74.1 | — | 8.7 | 2.86 | 10 | 4.9 | 8.7 | 24.4 |
| Example 9 | 38.2 | 61.8 | — | — | 1.62 | 19 | 1.2 | 8.0 | 31.6 |
| Example 10 | 38.6 | 61.4 | — | — | 1.59 | 14 | 5.2 | 8.4 | 21.4 |
| Example 11 | 39.1 | 60.9 | — | — | 1.56 | 12 | 9.8 | 8.6 | 14.9 |
| Example 12 | 20.9 | 79.1 | — | — | 3.78 | 17 | 1.2 | 8.6 | 25.6 |
| Example 13 | 20.3 | 79.7 | — | — | 3.93 | 13 | 4.9 | 9.4 | 16.1 |
| Example 14 | 21.2 | 78.8 | — | — | 3.72 | 6 | 9.1 | 10.1 | 10.1 |
| Example 15 | 25.8 | 73.7 | 0.5 | — | 2.86 | 19 | 1.3 | 8.3 | 38.8 |
| Example 16 | 25.6 | 74.0 | 0.4 | — | 2.89 | 12 | 5.2 | 9.0 | 29.4 |
| Example 17 | 25.9 | 73.3 | 0.6 | — | 2.83 | 9 | 9.5 | 10.0 | 19.0 |
| Example 18 | 25.0 | 72.0 | 3.0 | — | 2.88 | 18 | 1.2 | 8.4 | 39.2 |
| Example 19 | 25.8 | 71.0 | 3.2 | — | 2.75 | 11 | 4.8 | 9.2 | 29.8 |
| Example 20 | 26.0 | 71.6 | 2.4 | — | 2.75 | 8 | 8.7 | 9.9 | 19.2 |
| Example 21 | 24.2 | 69.0 | 6.8 | — | 2.85 | 19 | 1.2 | 8.5 | 42.8 |
| Example 22 | 23.9 | 69.9 | 6.2 | — | 2.92 | 12 | 5.4 | 9.1 | 30.1 |
| Example 23 | 24.5 | 68.9 | 6.6 | — | 2.81 | 7 | 9.8 | 9.9 | 20.4 |

TABLE 1-continued

| | Sm (at %) | Fe (at %) | C (at %) | Ce (at %) | T amount/R amount | Ratio (%) of main phase grains having crystal grain size of less than 0.4 μm | Average crystal grain size (μm) | Mr (kG) | Hc (kOe) |
|---|---|---|---|---|---|---|---|---|---|
| Example 24 | 24.1 | 69.9 | 6.0 | — | 2.90 | 6 | 14.2 | 10.1 | 10.4 |
| Example 25 | 23.0 | 63.1 | 13.9 | — | 2.74 | 19 | 1.5 | 8.1 | 29.2 |
| Example 26 | 23.1 | 62.9 | 14.0 | — | 2.72 | 15 | 6.0 | 8.0 | 21.4 |
| Example 27 | 23.6 | 61.8 | 14.6 | — | 2.62 | 11 | 9.2 | 8.3 | 12.5 |
| Example 28 | 20.8 | 63.8 | 15.4 | — | 3.07 | 19 | 1.8 | 8.0 | 21.2 |
| Example 29 | 21.8 | 62.9 | 15.3 | — | 2.89 | 12 | 9.1 | 8.1 | 9.1 |
| Comparative Example 1 | 25.8 | 74.2 | — | — | 2.88 | 62 | 0.5 | 7.3 | 39.2 |
| Comparative Example 2 | 26.0 | 74.0 | — | — | 2.85 | 21 | 0.9 | 7.8 | 38.9 |
| Comparative Example 3 | 40.2 | 59.8 | — | — | 1.49 | 19 | 1.8 | 4.7 | 9.2 |
| Comparative Example 4 | 40.5 | 59.5 | — | — | 1.47 | 11 | 9.4 | 4.9 | 8.9 |
| Comparative Example 5 | 19.2 | 80.8 | — | — | 4.21 | 19 | 1.2 | 8.2 | 8.2 |
| Comparative Example 6 | 19.3 | 80.7 | — | — | 4.18 | 6 | 8.8 | 8.5 | 4.2 |
| Comparative Example 7 | 24.1 | 69.9 | 6.0 | — | 2.90 | 22 | 0.8 | 7.5 | 40.1 |
| Comparative Example 8 | 26.0 | 74.0 | — | — | 2.85 | — | — | 1.4 | 1.4 |
| Comparative Example 9 | 26.9 | 73.1 | — | — | 2.72 | 24 | 1.7 | 6.8 | 20.9 |
| Comparative Example 10 | 26.4 | 73.6 | — | — | 2.79 | — | — | 0.5 | 0.9 |

TABLE 2

| | Sm (at %) | Fe (at %) | C (at %) | Ce (at %) | Pr (at %) | Nd (at %) | T amount/R amount | Ratio (%) of main phase grains having crystal grain size of less than 0.4 μm | Average crystal grain size (μm) | Mr (kG) | Hc (kOe) |
|---|---|---|---|---|---|---|---|---|---|---|---|
| Example α | 25.4 | 74.1 | 0 | 0 | 0.5 | 0 | 2.86 | 8 | 5.0 | 9.1 | 29.1 |
| Example β | 24.0 | 74.0 | 0 | 0 | 2.0 | 0 | 2.85 | 8 | 5.0 | 9.2 | 29.0 |
| Example γ | 19.4 | 74.2 | 0 | 0 | 6.4 | 0 | 2.88 | 7 | 5.2 | 9.4 | 24.3 |
| Example δ | 13.9 | 74.3 | 0 | 0 | 11.8 | 0 | 2.89 | 7 | 5.3 | 9.7 | 15.9 |
| Example ε | 25.6 | 74.0 | 0 | 0 | 0 | 0.4 | 2.85 | 9 | 5.0 | 9.1 | 29.0 |
| Example ζ | 23.9 | 74.2 | 0 | 0 | 0 | 1.9 | 2.88 | 9 | 4.9 | 9.2 | 28.5 |
| Example η | 19.6 | 74.3 | 0 | 0 | 0 | 6.1 | 2.89 | 8 | 5.3 | 9.3 | 23.9 |
| Example θ | 13.7 | 74.4 | 0 | 0 | 0 | 11.9 | 2.91 | 7 | 5.4 | 9.6 | 13.4 |
| Example ι | 23.8 | 74.1 | 0 | 0 | 1.2 | 0.9 | 2.86 | 8 | 5.1 | 9.2 | 28.8 |
| Example κ | 19.2 | 74.4 | 0 | 0 | 3.2 | 3.2 | 2.91 | 7 | 5.4 | 9.5 | 24.1 |
| Example λ | 13.4 | 74.7 | 0 | 0 | 6.0 | 5.9 | 2.95 | 7 | 5.6 | 9.7 | 14.3 |
| Example μ | 20.3 | 73.2 | 0 | 0 | 6.5 | 0 | 2.73 | 5 | 13.6 | 10.3 | 9.1 |
| Example ν | 12.8 | 74.1 | 0 | 0 | 13.1 | 0 | 2.86 | 7 | 5.0 | 9.4 | 9.2 |
| Example ξ | 18.9 | 74.0 | 0 | 1.2 | 5.9 | 0 | 2.85 | 7 | 5.1 | 9.4 | 22.5 |
| Example ○ | 18.7 | 72.0 | 3.1 | 0 | 6.2 | 0 | 2.89 | 9 | 5.1 | 9.4 | 25.0 |
| Example π | 18.0 | 69.8 | 6.1 | 0 | 6.1 | 0 | 2.90 | 11 | 5.1 | 9.3 | 25.8 |
| Example ρ | 16.3 | 63.0 | 15.2 | 0 | 5.5 | 0 | 2.89 | 14 | 5.2 | 8.4 | 14.2 |

Permanent magnets according to Example 2 to Example 7 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 3 hours in Example 2, for 5 hours in Example 3, for 15 hours in Example 4, for 48 hours in Example 5, for 96 hours in Example 6, and for 360 hours in Example 7. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, a keeping time in the crystallization treatment process is different in Example 2 to Example 7, compared to Example 1.

A permanent magnet according to Example 8 will be described. Sm, Ce, and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 15 hours. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, a part of Sm is substituted with Ce in Example 8, compared to Example 4.

A permanent magnet according to Example 9 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 2 hours. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as with Example 1, and thus, an anisotropic permanent magnet was obtained. That is, the ratio of Sm and Fe is different in Example 9, compared to Example 1.

Permanent magnets according to Example 10 and Example 11 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 15 hours in Example 10 and for 96 hours in Example 11. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, the keeping time in the crystallization treatment process is different in Example 10 and Example 11, compared to Example 9.

A permanent magnet according to Example 12 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 2 hours. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, the ratio of Sm and Fe is different in Example 12, compared to Example 1.

Permanent magnets according to Example 13 and Example 14 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 15 hours in Example 13 and for 96 hours in Example 14. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, the keeping time in the crystallization treatment process is different in Example 13 and Example 14, compared to Example 12.

A permanent magnet according to Example 15 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 2 hours. After that, the obtained quenched alloy was rapidly cooled at 20° C./s, was subjected to a carbonization treatment at 600° C. for 30 minutes, and was further rapidly cooled. A crystallization treatment process was performed in an Ar atmosphere, and a carbonization treatment process was performed in an Ar+$CH_4$ atmosphere. A $CH_4$ gas concentration was 0.5 wt %. The obtained alloy was pulverized, was kneaded, and was subjected to injection molding, in the same procedure as that of Example 1, and thus, an anisotropic permanent magnet was obtained. That is, the carbonization treatment is performed and C amount is different in Example 15, compared to Example 1.

Permanent magnets according to Example 16 and Example 17 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 15 hours in Example 16 and for 96 hours in Example 17. After that, the obtained quenched alloy was rapidly cooled at 20° C./s, was subjected to a carbonization treatment at 600° C. for 30 minutes, and was further rapidly cooled. A crystallization treatment process was performed in an Ar atmosphere, and a carbonization treatment process was performed in an Ar+$CH_4$ atmosphere. A $CH_4$ gas concentration was 0.5 wt %. The obtained alloy was pulverized, was kneaded, and was subjected to injection molding, in the same procedure as that of Example 1, and thus, an anisotropic permanent magnet was obtained. That is, the keeping time in the crystallization treatment process is different in Example 16 and Example 17, compared to Example 15.

A permanent magnet according to Example 18 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 2 hours. After that, the obtained quenched alloy was rapidly cooled at 20° C./s, was subjected to a carbonization treatment at 600° C. for 30 minutes, and was further rapidly cooled. A crystallization treatment process was performed in an Ar atmosphere, and a carbonization treatment process was performed in an Ar+$CH_4$ atmosphere. A $CH_4$ gas concentration was 3 wt %. The obtained alloy was pulverized, was kneaded, and was subjected to injection molding, in the same procedure as that of Example 1, and thus, an anisotropic permanent magnet was obtained. That is, the $CH_4$ gas concentration in the carbonization treatment process is different and the C amount is different in Example 18, compared to Example 15.

Permanent magnets according to Example 19 and Example 20 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 15 hours in Example 19 and for 96 hours in Example 20. After that, the obtained quenched alloy was rapidly cooled at 20° C./s, was subjected to a carbonization treatment at 600° C. for 30 minutes, and was further rapidly cooled. A crystallization treatment process was performed in an Ar atmosphere, and a carbonization treatment process was performed in an Ar+$CH_4$ atmosphere. A $CH_4$ gas concentration was 3 wt %. The obtained alloy was pulverized, was kneaded, and was subjected to injection molding, in the same procedure as that of Example 1, and thus, an anisotropic permanent magnet was obtained. That is, the keeping time in the crystallization treatment process is different in Example 19 and Example 20, compared to Example 18.

A permanent magnet according to Example 21 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 2 hours. After that, the obtained quenched alloy was rapidly cooled at 20° C./s, was subjected to a carbonization treatment at 600° C. for 30 minutes, and was further rapidly cooled. A crystallization treatment process was performed in an Ar atmosphere, and a carbonization treatment process was performed in an Ar+$CH_4$ atmosphere. A $CH_4$ gas concentration was 10 wt %. The obtained alloy was pulverized, was kneaded, and was subjected to injection molding, in the same procedure as that of Example 1, and thus, an anisotropic permanent magnet was obtained. That is, the $CH_4$ gas concentration in the carbonization treatment process is different and the C amount is different in Example 21, compared to Example 15.

Permanent magnets according to Example 22 to Example 24 will be described. Sm and Fe were blended at a composition ratio shown in Table 1, an ingot was prepared as with Example 18, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 15 hours in Example 22, for 96 hours in Example 23, and for 360 hours in Example 24. After that, the obtained quenched alloy was rapidly cooled at 20° C./s, was subjected to a carbonization treatment at 600° C. for 30 minutes, and was further rapidly cooled. A crystallization treatment process was performed in an Ar atmosphere, and a carbonization treatment process was performed in an Ar+$CH_4$ atmosphere. A $CH_4$ gas concentration was 10 wt %. The obtained alloy was pulverized, was kneaded, and was subjected to injection molding, in the same procedure as that of Example 1, and thus, an anisotropic permanent magnet was obtained. That is, the keeping time in the crystallization treatment process is different in Example 22 to Example 24, compared to Example 21.

A permanent magnet according to Example 25 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 2 hours. After that, the obtained quenched alloy was rapidly cooled at 20° C./s, was subjected to a carbonization treatment at 600° C. for 30 minutes, and was further rapidly cooled. A crystallization treatment process was performed in an Ar atmosphere, and a carbonization treatment process was performed in an Ar+$CH_4$ atmosphere. A $CH_4$ gas concentration was 40 wt %. The obtained alloy was pulverized, was kneaded, and was subjected to injection molding, in the same procedure as that of Example 1, and thus, an anisotropic permanent magnet was obtained. That is, the $CH_4$ gas concentration in the carbonization treatment process is different in Example 25, compared to Example 15.

Permanent magnets according to Example 26 and Example 27 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 15 hours in Example 26 and for 96 hours in Example 27. After that, the obtained quenched alloy was rapidly cooled at 20° C./s, was subjected to a carbonization treatment at 600° C. for 30 minutes, and was further rapidly cooled. A crystallization treatment process was performed in an Ar atmosphere, and a carbonization treatment process was performed in an Ar+$CH_4$ atmosphere. A $CH_4$ gas concentration was 40 wt %. The obtained alloy was pulverized, was kneaded, and was subjected to injection molding, in the same procedure as that of Example 1, and thus, an anisotropic permanent magnet was obtained. That is, the keeping time in the crystallization treatment process is different in Example 26 and Example 27, compared to Example 25.

A permanent magnet according to Example 28 will be described. Sm and Fe were blended at a composition ratio shown in Table 1, an ingot was prepared as with Example 1, and a quenched alloy was prepared. The obtained quenched alloy was subjected to a heating at a 20° C./s, was kept at the first crystallization temperature of 800° C. for 1 minute, was rapidly cooled at 20° C./s, and was kept at the second crystallization temperature of 650° C. for 2 hours. After that, the obtained quenched alloy 20° C./s was rapidly cooled, was subjected to a carbonization treatment at 600° C. for 30 minutes, and was further rapidly cooled. A crystallization treatment process was performed in an Ar atmosphere, and a carbonization treatment process was performed in an Ar+$CH_4$ atmosphere. A $CH_4$ gas concentration was 50 wt %. The obtained alloy was pulverized, was kneaded, and was subjected to injection molding, in the same procedure as that of Example 1, and thus, an anisotropic permanent magnet was obtained. That is, the $CH_4$ gas concentration in the carbonization treatment process is different in Example 28, compared to Example 15.

A permanent magnet according to Example 29 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 96 hours. After that, the obtained quenched alloy was rapidly cooled at 20° C./s, was subjected to a carbonization treatment at 600° C. for 30 minutes, and was further rapidly cooled. A crystallization treatment process was performed in an Ar atmosphere, and a carbonization treatment process was performed in an Ar+$CH_4$ atmosphere. A $CH_4$ gas concentration was 50 wt %. The obtained alloy was pulverized, was kneaded, and was subjected to injection molding, in the same procedure as that of Example 1, and thus, an anisotropic permanent magnet was obtained. That is, the keeping time in the crystallization treatment process is different in Example 29, compared to Example 28.

Permanent magnets according to Comparative Example 1 and Comparative Example 2 will be described. Sm and Fe were blended at a composition ratio shown in Table 1, an ingot was prepared as with Example 1, and a quenched alloy was prepare. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 0.2 hours in Comparative Example 1 and for 0.5 hours in Comparative Example 2. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, the keeping time in the crystallization treatment process is different in Comparative Example 1 and Comparative Example 2, compared to Example 1.

Permanent magnets according to Comparative Example 3 and Comparative Example 5 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 2 hours. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, the composition ratio of Sm and Fe is different in Comparative Example 3 and Comparative Example 5, compared to Example 1.

Permanent magnets according to Comparative Example 4 and Comparative Example 6 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 96 hours. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, the composition ratio of Sm and Fe is different in Comparative Example 4 and Comparative Example 6, compared to Example 6.

A permanent magnet according to Comparative Example 7 will be described. Sm and Fe were blended at a composition ratio shown in Table 1, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 0.5 hours. After that, the obtained quenched alloy was rapidly cooled at 20° C./s, was subjected to a carbonization treatment at 600° C. for 30 minutes, and was further rapidly cooled. A crystallization treatment process was performed in an Ar atmosphere, and a carbonization treatment process was performed in an Ar+$CH_4$ atmosphere. A $CH_4$ gas concentration was 10 wt %. The obtained alloy was pulverized, was kneaded, and was subjected to injection molding, in the same procedure as that of Example 1, and thus, an anisotropic permanent magnet was obtained. That is, the keeping time in the crystallization treatment process is different in Comparative Example 7, compared to Example 21.

Permanent magnets according to Comparative Example 8 to Comparative Example 10 will be described. Sm and Fe were blended at a composition ratio shown in Table 1, an ingot was prepared as with Example 1, and a quenched alloy was prepared. The obtained quenched alloy was subjected to a heating at 20° C./s, was kept at the crystallization temperature of 800° C. in Comparative Example 8, at the crystallization temperature of 700° C. in Comparative Example 9, and at the crystallization temperature 650° C. in Comparative Example 10, for 1 hour, and was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, the crystallization treatment process is different in Comparative Example 8 to Comparative Example 10, compared to Example 1.

Permanent magnets according to Example α to Example λ will be described. Sm, Pr, Nd, and Fe were blended at a composition ratio shown in Table 2, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 15 hours. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, a part of Sm is substituted with Pr and Nd in Example α to Example λ, compared to Example 4.

A permanent magnet according to Example μ will be described. Sm, Pr, and Fe were blended at a composition ratio shown in Table 2, an ingot was prepared as with Example 1, and a quenched alloy was prepared. The obtained quenched alloy was subjected to a heating at a 20° C./s, was kept at the first crystallization temperature of 800° C. for 1 minute, was rapidly cooled at 20° C./s, and was kept at the second crystallization temperature of 650° C. for 360 hours. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, a part of Sm is substituted with Pr in Example μ, compared to Example 7.

A permanent magnet according to Example ν will be described. Sm, Pr, and Fe were blended at a composition ratio shown in Table 2, an ingot was prepared as with Example 1, and a quenched alloy was prepared. The obtained quenched alloy was subjected to a heating at 20°

C./s, was kept at the first crystallization temperature of 800° C. for 1 minute, was rapidly cooled at 20° C./s, and was kept at the second crystallization temperature of 650° C. for 15 hours. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, a ratio in which a part of Sm is substituted with Pr is different in Example ν, compared to Example α.

A permanent magnet according to Example ξ will be described. Sm, Ce, Pr, and Fe were blended at a composition ratio shown in Table a, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 15 hours. After that, the obtained quenched alloy was rapidly cooled at 20° C./s. A crystallization treatment process was performed in an Ar atmosphere. The obtained alloy was pulverized, was kneaded, and was subjected to injection molding, in the same procedure as that of Example 1, and thus, an anisotropic permanent magnet was obtained. That is, a part of Sm is substituted with Ce and Pr in Example ξ, compared to Example 4.

Permanent magnets according to Example o, Example π, and Example ρ will be described. Sm, Pr, and Fe were blended at a composition ratio shown in Table 2, an ingot was prepared as with Example 1, and a quenched alloy was prepared. The obtained quenched alloy was subjected to a heating at 20° C./s, was kept at the first crystallization temperature of 800° C. for 1 minute, was rapidly cooled at 20° C./s, and was kept at the second crystallization temperature of 650° C. for 15 hours. After that, the obtained quenched alloy was rapidly cooled at 20° C./s, was subjected to a carbonization treatment at 600° C. for 30 minutes, and was further rapidly cooled. A crystallization treatment process was performed in an Ar atmosphere, and a carbonization treatment process was performed in an Ar+$CH_4$ atmosphere. A $CH_4$ gas concentration was 3 wt % in Example o, the $CH_4$ gas concentration was 10 wt % in Example π, and the $CH_4$ gas concentration was 50 wt % in Example ρ. The obtained alloy was pulverized, was kneaded, and was subjected to injection molding, in the same procedure as that of Example 1, and thus, an anisotropic permanent magnet was obtained. That is, the carbonization treatment is performed and the C amount is different in Example o, Example π, and Example ρ, compared to Example γ.

Example 1 to Example 7, Comparative Example 1, and Comparative Example 2

The composition ratio of R and T was fixed, and the keeping time in the crystallization treatment process was considered. In each of Examples 1 to 7, Comparative Example 1, and Comparative Example 2, the $R_5T_{17}$ crystal phase was confirmed from XRD measurement. In Example 1 to Example 7, the average crystal grain size is grown to 1 to 19 μm or so. In addition, the main phase grains having the crystal grain size of less than 0.4 μm are less than 20%. In contrast, in Comparative Example 1 and Comparative Example 2, the average crystal grain size is small, and the main phase grains having the crystal grain size of less than 0.4 μm are abundant. Thus, in Example 1 to Example 7, the residual magnetization of 6.4 kG or more that is more than that of Comparative Example 1 and Comparative Example 2 is obtained. That is, it is considered that in Examples 1 to 7, the anisotropy can be obtained by the pulverization treatment. In addition, the coercivity decreases in Example 7, compared to Example 1 to Example 6. It is considered that this is because in Example 7, the average crystal grain size was distanced from a single-domain grain size. In order for a permanent magnet to obtain a large coercivity of 9.0 kOe or more along with large residual magnetization, it is particularly excellent that the average crystal grain size is in a range of 1 μm to 10 μm.

Example 1, Example 9, Example 12, Comparative Example 3, and Comparative Example 5

The R amount and the composition ratio of R and T were considered. In each of Example 1, Example 9, Example 12, Comparative Example 3, and Comparative Example 5, the $R_5T_{17}$ crystal phase was confirmed from the XRD measurement. In addition, a specimen of a structure having approximately the same crystal grain size was obtained by the same crystallization treatment. Here, in Example 1, Example 9, and Example 12, a comparatively excellent coercivity of 9.0 kOe or more, and the residual magnetization of 6.4 kG or more were obtained, but in Comparative Example 3, the residual magnetization decreased, and in Comparative Example 5, the coercivity decreased. In Comparative Example 3, the R amount was large, and thus, an $SmFe_2$ phase of small magnetization was greatly generated, and in Comparative Example 5, the R amount was small, and thus, a α-Fe phase of a low coercivity was greatly generated.

Example 6, Example 11, Example 14, Comparative Example 4, and Comparative Example 6

The R amount, and the composition ratio of R and T were considered in a crystallization treatment condition of Example 6. In each of Example 6, Example 11, Example 14, Comparative Example 3, and Comparative Example 5, the $R_5T_{17}$ crystal phase was confirmed from the XRD measurement. In addition, a specimen of a structure having approximately the same crystal grain size was obtained by the same crystallization treatment. Here, in Example 6, Example 11, and Example 14, a comparatively excellent coercivity of 9.0 kOe or more, and the residual magnetization of 6.4 kG or more were obtained, but in Comparative Example 4, the residual magnetization decreased, and in Comparative Example 6, the coercivity decreased. In Comparative Example 4, the R amount was large, and thus, an $SmFe_2$ phase of small magnetization was greatly generated, and in Comparative Example 6, the R amount was small, and thus, an α-Fe phase of a low coercivity was greatly generated.

Example 4 and Example 8

In Example 8, a part of an Sm component in the specimen of Example 4 is substituted with Ce. In Example 8, the $R_5T_{17}$ crystal phase was also confirmed from the XRD measurement. Even in a case where R was Sm and Ce, it was possible to confirm the $R_5T_{17}$ crystal phase by the XRD, it was possible to control the crystal grain size according to the crystallization treatment process, and it was possible to obtain an excellent anisotropic permanent magnet.

Example 15, Example 18, Example 21, Example 25, and Example 28

The R amount, and the composition ratio of R and T were fixed, the $CH_4$ gas concentration in the carbonization treatment process was changed, and the C amount in the specimen was considered. In each of Example 15, Example 18, Example 21, Example 25, and Example 28, the $R_5T_{17}$ crystal phase was confirmed from the XRD measurement. In addition, a structure having approximately the same crystal grain size was obtained by the same crystallization treatment. In Example 15, Example 18, and Example 21, the coercivity increased compared to Example 1. It is considered that this is because a suitable C amount forms solid solution in the main phase grain, and thus, an interatomic distance between T-T increases, and an exchange mutual interaction between T-T becomes stronger. On the other hand, in Example 28, the coercivity and the residual magnetization decreased compared to Example 15, Example 18, Example 21, and Example 25. It is considered that this is because the C amount was large, and the ratio of the $R_5T_{17}$ crystal phase decreased. In a case where the range of the C amount is more than 0 at % and 15 at % or less, it is possible to obtain a permanent magnet having particularly excellent magnetic properties.

Example 21 to Example 24, and Comparative Example 7

The R amount, and the composition ratio of R and T were fixed, the $CH_4$ gas concentration in the carbonization treatment process was fixed, and the keeping time in the crystallization treatment process was considered. In each of Examples 21 to 24 and Comparative Example 7, the $R_5T_{17}$ crystal phase was also confirmed from the XRD measurement. In Example 21 to Example 24, the crystals are grown until the average the crystal grain size of the main phase is 1 to 19 μm or so, and the residual magnetization of more than that of Comparative Example 7 is obtained. It is considered that the crystals were grown, and thus, a large number of grains in which a crystal orientation was aligned were formed by the pulverization treatment, and anisotropy at the time of magnetic field orientation was advanced. In addition, in Example 24, the coercivity was comparatively small. It is considered that this is because the average crystal grain size of the main phase grains was more than 10 μm, and thus, the average crystal grain size excessively increased compared to the single-domain grain size. Even in a case where C forms solid solution, it is particularly excellent that the average crystal grain size is in a range of 1 μm to 10 μm in order to obtain a comparatively large coercivity along with large residual magnetization.

Example 1, and Comparative Example 8 to Comparative Example 10

In Comparative Example 8 to Comparative Example 10, the crystallization treatment process is not performed in two steps. In Comparative Example 9 and Comparative Example 10, the $R_5T_{17}$ crystal phase was confirmed from the XRD measurement. In Comparative Example 8 in which the crystallization treatment was performed at 800° C. for 1 hour, the $R_5T_{17}$ crystal phase was not obtained. In Comparative Example 9 in which the crystallization treatment was performed at 700° C. for 1 hour, the $R_5T_{17}$ crystal phase was obtained, and the average crystal grain size was 1.7 μm. However, an $R_5T_{17}$ crystal phase having a sufficiently large crystal grain size and a crystal phase having a fine crystal grain size coexisted, and the crystal grain size of 24% in the main phase grains was less than 0.4 μm, and thus, an excellent residual magnetization value was not obtained. In Comparative Example 10, an excellent coercivity was not also obtained, and it is considered that this is because the treatment temperature was low, and the average crystal grain size of a sufficient size was not obtained.

Example 4, and Example α to Example λExample 7 and Example μ

In Example α to Example λ, a part of the Sm component in the specimen of Example 4 is substituted with Pr or Nd, or both of Pr and Nd. In Example μ, a part of the Sm component in the specimen of Example 7 is substituted with Pr. In Example α to Example λ, and Example μ, the $R_5T_{17}$ crystal phase was also confirmed from the XRD measurement. In Example α to Example λ, a part of Sm was substituted with Pr and/or Nd, and thus, the magnetization was improved compared to Example 4. In Example μ, a part of the Sm component was substituted with Pr, and thus, the magnetization was improved compared to Example 7. It is considered that this is because the magnetic moment is improved due to the substitution of a part of Sm with Pr and/or Nd. Then, a part of Sm was substituted with Pr and/or Nd, and thus, it was possible to obtain a particularly excellent anisotropic permanent magnet.

Example α to Example δ, and Example ν

In Example ν, Pr amount is large compared to Example α to Example δ. It is considered that in Example ν, the $R_5T_{17}$ crystal phase was also obtained from the XRD measurement, but the Pr amount was large, and thus, an effect of decreasing magnetocrystalline anisotropy was large, and the coercivity decreased compared to Example α to Example δ. In addition, in Example ν, the residual magnetization also decreased compared to Example δ. It is considered that a decrease in the residual magnetization occurs due to a decrease in the magnetocrystalline anisotropy according to an increase in the Pr amount, and an increase in the ratio of the $R_2T_{17}$ phase according to the ratio of Pr to the entire R of more than 50 at %. Further, it is considered that this is because the $R_2T_{17}$ phase having in-plane anisotropy increased, and thus, a kink was generated in the vicinity of 0 magnetic field of a demagnetization curve. In Examples α to δ in which the ratio of the total of Pr and Nd to the entire R was 50 at % or less, it was possible to obtain a comparatively large coercivity along with large residual magnetization, and it was possible to obtain a particularly excellent anisotropic permanent magnet.

Example γ and Example ξ

In Example ξ, the substitution of Ce is also performed along with Pr, compared to Example γ. In Example ξ, the $R_5T_{17}$ crystal phase was also obtained from the XRD measurement, and it was possible to obtain the residual magnetization and the coercivity approximately equivalent to those of Example γ. In the substitution of other elements, it is also possible to obtain an excellent anisotropic permanent magnet.

Example γ, Example o, Example π, and Example ρ

In Example o, Example π, and Example ρ, the carbonization treatment was performed to Example γ, and thus, carbon formed solid solution in the main phase grain. In Example o and Example π, carbon formed solid solution, and thus, it was possible to obtain the coercivity larger than that of Example γ. It is considered that in Example o and Example π, the C amount formed solid solution, and thus, it was possible to obtain particularly excellent magnetic properties. On the other hand, in Example ρ, the coercivity and the residual magnetization decreased compared to Example o. As with Example 28, it is considered that this is because the C amount was large, and the ratio of the $R_5T_{17}$ crystal phase decreased. That is, insofar as the range of the C amount is more than 0 at % and 15 at % or less, it is possible to obtain particularly excellent magnetic properties.

What is claimed is:

1. A permanent magnet comprising R and T, R being essentially Sm or being at least one selected from rare earth elements in addition to Sm, and T being essentially Fe or a combination of Fe and Co or being at least one selected from transition metal elements in addition to Fe or the combination of Fe and Co, wherein a composition ratio of R in the permanent magnet is 20 at % or more and 40 at % or less, a remaining part is substantially only T, or only T and C, T amount is more than 1.5 times of R amount and less than 4.0 times of the R amount, main phase grains included in the permanent magnet have an $Nd_5Fe_{17}$ type crystal structure, an average crystal grain size of the main phase grains of the permanent magnet is greater than 1 μm, and a number ratio of main phase grains having a crystal grain size of less than 0.4 μm is less than 20%, and C amount is 0 at % or more and 15.4 at % or less.

2. The permanent magnet according to claim 1, wherein C amount is more than 0 at % and 15 at % or less.

3. The permanent magnet according to claim 1, wherein the average crystal grain size of the main phase grains is greater than 1 μm and less than 10 μm.

4. A permanent magnet powder comprising R and T, R being essentially Sm or being at least one selected from rare earth elements in addition to Sm, and T being essentially Fe or a combination of Fe and Co or being at least one selected from transition metal elements in addition to Fe or the combination of Fe and Co, wherein a composition ratio of R in the permanent magnet powder is 20 at % or more and 40 at % or less, a remaining part is substantially only T, or only T and C, T amount is more than 1.5 times of R amount and less than 4.0 times of the R amount, main phase grains included in the permanent magnet powder have an $Nd_5Fe_{17}$ type crystal structure, an average crystal grain size of the main phase grains of the permanent magnet powder is more than 1 μm, and a number ratio of main phase grains having a crystal grain size of less than 0.4 μm is less than 20%, and C amount is 0 at % or more and 15.4 at % or less.

5. The permanent magnet powder according to claim 4, wherein C amount is more than 0 at % and 15 at % or less.

6. The permanent magnet according to claim 4, wherein the average crystal grain size of the main phase grains is greater than 1 μm and less than 10 μm.

7. An anisotropic bond magnet, including:

the permanent magnet powder according to claim 4; and a resin.

8. An anisotropic sintered magnet comprising the permanent magnet powder according to claim 4.

* * * * *